US009574378B2

(12) United States Patent
Wu et al.

(10) Patent No.: US 9,574,378 B2
(45) Date of Patent: Feb. 21, 2017

(54) LOCK FOR ELECTRONIC DEVICE

(71) Applicant: SINOX CO., LTD., New Taipei (TW)

(72) Inventors: Chia Ming Wu, New Taipei (TW); Chun-Sheng Wu, New Taipei (TW)

(73) Assignee: SINOX CO., LTD., New Taipei (TW)

( * ) Notice: Subject to any disclaimer, the term of this patent is extended or adjusted under 35 U.S.C. 154(b) by 0 days.

(21) Appl. No.: 13/950,269

(22) Filed: Jul. 24, 2013

(65) Prior Publication Data

US 2014/0026625 A1 Jan. 30, 2014

Related U.S. Application Data

(60) Provisional application No. 61/691,005, filed on Aug. 20, 2012, provisional application No. 61/698,181, filed on Sep. 7, 2012.

(30) Foreign Application Priority Data

Jul. 24, 2012 (TW) ..... 101214309 U

(51) Int. Cl.

| | |
|---|---|
| ***E05B 73/00*** | (2006.01) |
| ***E05B 37/02*** | (2006.01) |
| ***E05B 17/04*** | (2006.01) |

(52) U.S. Cl.

CPC ..... *E05B 73/0082* (2013.01); *E05B 17/04* (2013.01); *E05B 37/02* (2013.01); *E05B 73/0005* (2013.01); *Y10T 70/40* (2015.04)

(58) Field of Classification Search

CPC .... E05B 73/00; E05B 73/003; E05B 73/0005; E05B 73/0082; E05B 2073/00; E05B 2073/0082; E05B 2073/0088

USPC ..... 70/14, 18, 19, 30, 49, 57, 57.1, 58, 427, 70/428, 429, 430

See application file for complete search history.

(56) References Cited

U.S. PATENT DOCUMENTS

| | | | | |
|---|---|---|---|---|
| 6,058,744 | A * | 5/2000 | Ling | E05B 37/025 70/28 |
| 6,199,413 | B1 * | 3/2001 | McDaid et al. | 70/58 |
| 6,227,017 | B1 * | 5/2001 | Igelmund | 70/58 |
| 6,257,029 | B1 * | 7/2001 | Liao | 70/58 |
| 6,619,081 | B1 * | 9/2003 | Yu | E05B 73/0005 70/14 |
| 6,779,370 | B2 * | 8/2004 | Bellow et al. | 70/58 |
| 8,302,435 | B2 * | 11/2012 | Burmesch et al. | 70/14 |
| 8,640,512 | B2 * | 2/2014 | Wu | 70/58 |
| 8,991,225 | B2 * | 3/2015 | Wu et al. | 70/58 |
| 2008/0034816 | A1 * | 2/2008 | Lu | E05B 73/0082 70/58 |
| 2010/0170304 | A1 * | 7/2010 | Anderson | 70/49 |
| 2011/0146358 | A1 * | 6/2011 | Avganim | 70/58 |
| 2012/0006080 | A1 * | 1/2012 | Yu et al. | 70/58 |
| 2012/0312056 | A1 * | 12/2012 | Yu et al. | 70/14 |

* cited by examiner

*Primary Examiner* — Christopher Boswell
(74) *Attorney, Agent, or Firm* — Cheng-Ju Chiang

(57) ABSTRACT

A lock for an electronic device having a lock hole includes a lock core, a fastener, and an adapter, wherein the lock core is operable and rotatable about a first axis; the fastener is connected to the lock core and is shifted away from the first axis. The adapter is connected to the lock core and the fastener. The rotation of the lock core about the first axis drives the adapter to drive the fastener to rotate about a second axis, When the lock core is locked, the locked lock core restricts the fastener from rotating, when the lock core is unlocked, the fastener is operable to rotate.

6 Claims, 19 Drawing Sheets

LOCK FOR ELECTRONIC DEVICE

BACKGROUND OF THE INVENTION

1. Field of the Invention

The present invention generally relates to a lock. Particularly, the present invention relates to a lock for an electronic device.

2. Description of the Prior Art

Consumer electronics play a very important role in the modern life. Fast lifestyle and eagerness for instant information make portable electronic devices become a necessity to most people. However, since these portable devices are in high demand, wide spread, high unit price, small volume, and high portability and become more and more popular, the possibility of being stolen or lost accordingly increases.

One type of locks is developed to against thieves. For example, laptop computer locks can be connected to the lock hole of electronic devices by a latch unit, wherein a locking operation enables the latch unit to be secured in the lock hole when the latch unit has been connected to the lock hole. An arrangement of the lock hole and a lock connected thereto usually do not interfere with a user's operation and the lock hole is located at a side 91 of a portable electronic device. As FIG. 1 shows, for example, a lock 8 can approach the lock hole of the electronic device 9 located at a back side to let a latch unit 81 thereof enter the lock hole without interfering with the operation of the lock 8 or the electronic device 9. However, since the electronic device 9 is getting thinner, the thickness on the side 91 is therefore reduced; meanwhile, the height "h" of the lock 8 or the length of a facing surface a may affect the alignment between the latch unit 81 and the lock hole. Consequently, the lock 8 and the electronic device 9 may not both rest on the supporting face t after the latch unit 81 of the lock 8 is inserted into the lock hole, wherein the back side of the electronic device 9 may be raised due to the lock 8, which may therefore affect the user's operation and the lock's efficacy.

SUMMARY OF THE INVENTION

It is an object of the present invention to provide a lock for an electronic device, which is better connected to the electronic device and provides better fixation.

The lock of the present invention includes a lock core, a fastener, and an adapter or a driving element, wherein the lock core substantially has a first axis and is operable and moveable along the first axis or rotatable about the first axis. A fastener is connected to the lock core and is shifted away from the first axis. The adapter or the driving element is connected to the lock core and the fastener, wherein a rotation of the lock core about the first axis drives the adapter or the driving element to drive the fastener to move relative to a second axis or rotate about the second axis. When the lock core is locked, the lock core restricts the fastener from moving; when the lock core is unlocked, the fastener is operable to move or rotate.

The fastener of the present invention has an extending rod and a retaining portion disposed at one end of the extending rod, and the retaining portion has an extension direction substantially perpendicular to the extending rod, wherein the fastener has the second axis passing through the extending rod and being operable and rotatable about the second axis. Alternatively, the fastener includes a plurality of lever arms surrounding the second axis; each lever arm has a pivot, an effort arm beside the pivot and a resistance arm beside the pivot and opposite to the effort arm, wherein the effort arm or the resistance arm moves toward or away from the second axis.

The lock of the present invention includes a housing; the lock core and the adapter or the driving member are disposed in the housing. The housing has a through hole formed thereon for the fastener extending out of the housing. The housing further includes a connecting element. The connecting element includes two confining pins and a through hole formed between the confining pins, wherein the extending rod of the fastener passes through the through hole and extends along the confining pins; the retaining portion protrudes beyond distal ends of the confining pins. When the fastener rotates, the retaining portion rotates relative to the distal ends of the confining pins so that the rotation of the fastener changes an orientation of the retaining portion relative to the confining pins.

The adapter of the present invention includes a driving element and a driven portion. The driving element is disposed on the lock core; the driven portion is located at one end of the extending rod other than the end connected to the retaining portion and movably contacts with the driving element. On the other hand, the lock core of key lock includes a first lock core portion and a second lock core portion connected to the first lock core portion along the first axis. The lock core moves toward the fastener along the first axis to a restriction position when the lock core is pressed and locked; on the contrary, the lock core moves away from the fastener along the first axis. The driving element is disposed at one side of the second lock core portion opposite to the side next to the first lock core portion; the first lock core portion is operable to rotate relative to the second lock core portion about the first axis. The driving element includes a columnar portion substantially disposed on the second lock core portion along the second axis and includes two pins formed at one end of the columnar portion away from the second lock core portion. The driven portion includes a hollow column corresponding to the columnar portion of the driving element, wherein the hollow column has two guiding portions obliquely extending from one end toward the other end thereof. Two pins of the driving element are moveably arranged in the two guiding portions. The columnar portion is moveably received in the hollow column while the hollow column is rotatable about the second axis and surrounds the columnar portion. The axial movement of the lock core drives the two pins of the driving element to move along the two guiding portions, and the pins contact against a wall of the guiding portions to drive the hollow column to rotate.

Alternatively, the driving element of the present invention includes a plate disposed on the lock core, the center of the plate has the first axis passing through, and at least one hole shifted away from the first axis is formed on an opposite surface of the plate. The driven portion includes a push rod and a protrusion, the push rod extends parallel to the opposite surface; the protrusion protruding toward the plate is formed on one end of the push rod and set in the hole. The lock core is a key lock core and includes the first lock core portion and the second lock core portion connected to the first lock core portion along the first axis, wherein the first lock core portion is rotatable relative to the second lock core portion about the first axis under an unlocking or a locking operation in which a key participates. The plate is set on a side opposite to one side of the second lock core portion connected to the first lock core portion. The rotation of the first lock portion drives the plate to rotate about the first axis. The at least one hole rotates around the first axis to drive the push rod to rotate.

Alternatively, the lock of the present invention includes the housing, the lock core, and the fastener. The lock core is disposed in the housing. The lock core substantially has a first axis and is operable and moveable along the first axis or rotatable about the first axis. The housing has a first surface, which is an outer surface thereof. The fastener is connected to the lock core and shifted away from the center of the first surface. The fastener is rotatable about the second axis or moveable relative to the second axis. The first axis intersects the first surface substantially at the center thereof; the second axis intersects the first surface at a position between an edge and the center of the first surface. When the lock core is locked, the lock core restricts the fastener from moving; when the lock core is unlocked, the fastener is operable to move or rotate.

DETAILED DESCRIPTION OF THE PREFERRED EMBODIMENT

Figure 1:
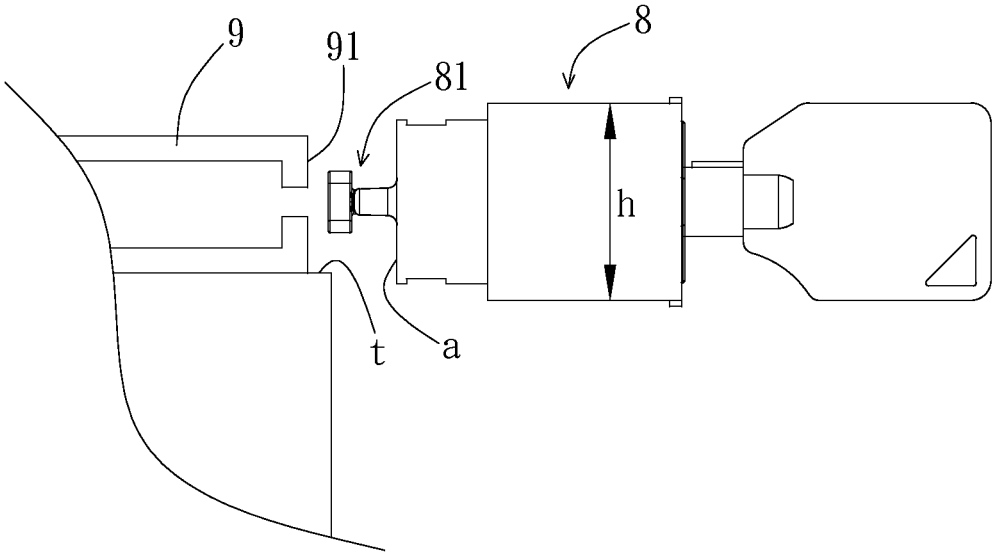
FIG. 1 (PRIOR ART)
FIG. 1 shows a schematic view of the conventional lock for electronic devices.
Figure 2A:
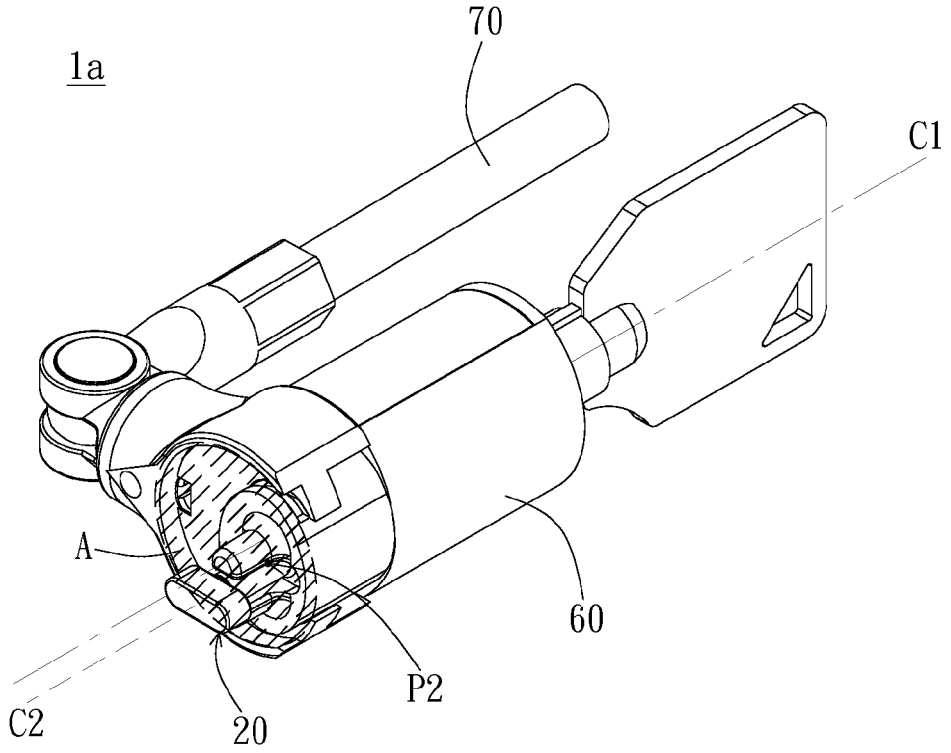
FIGS. 2A-2B are a perspective view and a front view of the embodiment of the lock of the present invention.
Figure 2B:
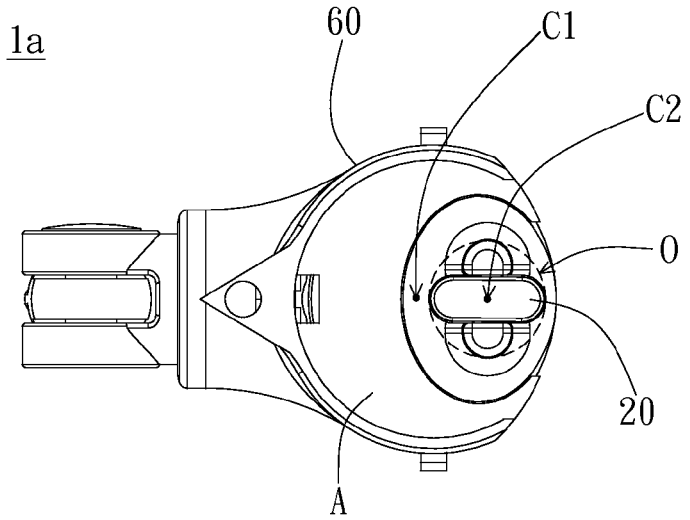

The present invention provides a lock for an electronic device. The electronic device includes, but is not limited to, portable electronic devices such as laptops or notebooks. In addition, the lock of the present invention can be for thin-type electronic device. The lock of the present invention may be a key lock or a combination lock. For example, the lock 1*a* shown in FIGS. 2A-2B is a key lock, which has a lock core (described later) operable and rotatable about a first axis C1 that passes through the lock core; for example, the lock core rotates about the first axis under a key's operation and is unlocked. In addition, in accordance with the usual setting of a lock core inside a lock, the first axis C1 is not only the central axis of the lock core but preferably also the central axis of the lock 1*a*. The lock 1*a* further includes a housing 60, a fastener 20, and an adapter (described later). The lock core and the adapter are disposed in the housing 60; the fastener 20 partially protrudes out of the housing 60 for being connected to a lock hole of the electronic device, wherein the fastener 20 is substantially connected with the lock core in an extension direction of the lock core and is shifted away from the first axis C1. Accordingly, in the preferred embodiment of the present invention, as shown in FIGS. 2A-2B, the fastener 20 protrudes out of a surface A of the housing 60 and is shifted away from the first axis C1 and the center of the surface A.

Figure 3:
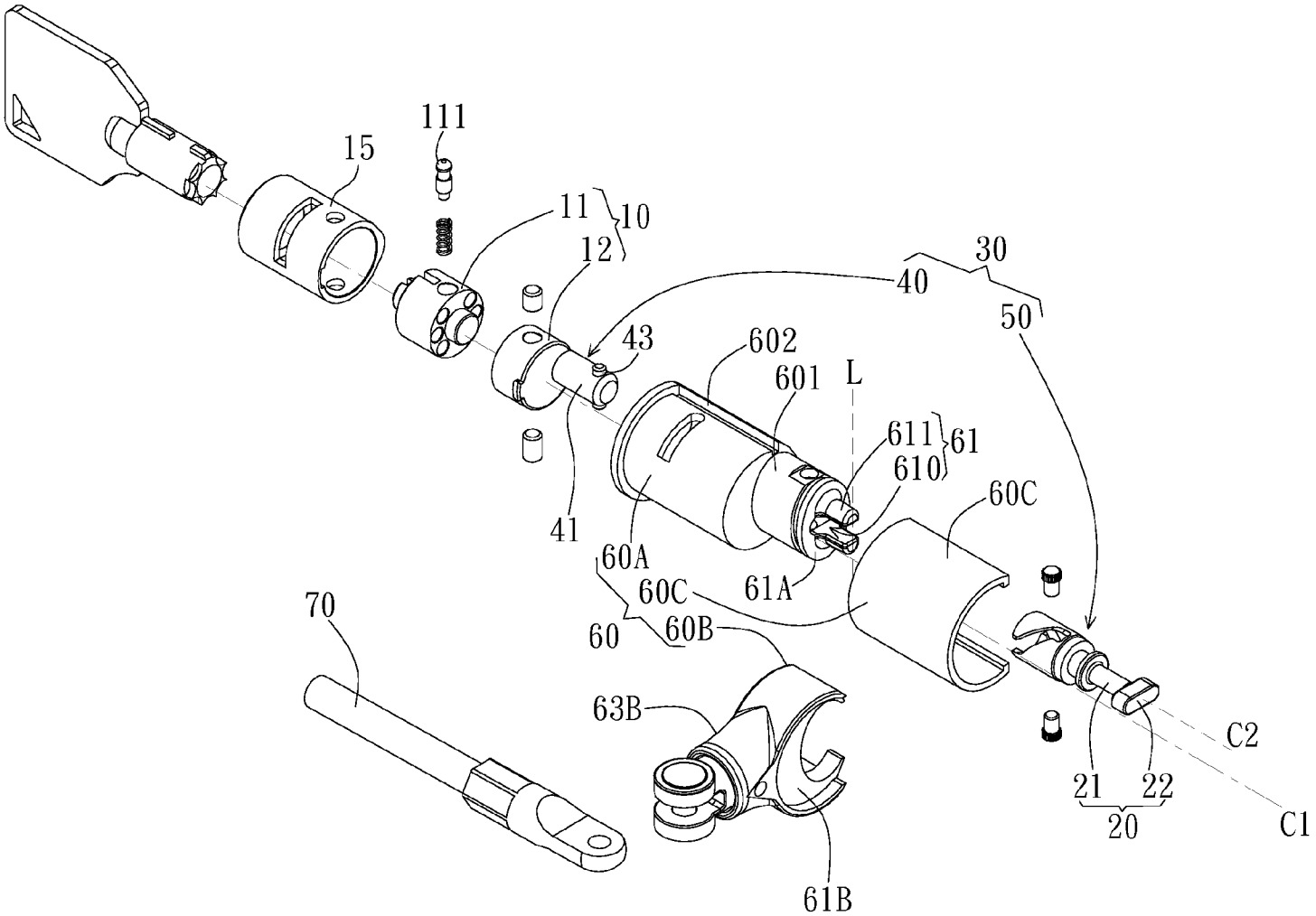
FIG. 3 is an exploded view of the embodiment shown in FIGS. 2A-2B.

Further, as shown in FIG. 3, the fastener 20 of the present invention may be composed of an extending rod 21 and a retaining portion 22. The retaining portion 22 is disposed at one end of the extending rod 21, i.e. the end away from the housing 60; the retaining portion 22 also has an extension direction substantially perpendicular to the extending rod 21 so as to constitute a T shape structure together with the extending rod 21. In addition, in the embodiment shown in FIG. 3, the fastener 20 is rotatable. The fastener 20 preferably rotates about a second axis C2 that passes through the extending rod 21 (i.e. revolving on the extending rod's own axis), wherein the rotation is in coordination with an unlocking/locking operation of the lock core 10. For example, when the lock core 10 is locked, the lock core 10 restricts the fastener 20 from rotating; when the lock core 10 is unlocked, the fastener 20 is operable to rotate. Furthermore, depending on a status after rotation, the fastener 20 can enter the lock hole, cannot enter the lock hole, or can be fastened in the lock hole. In the present invention, the second axis C2 is substantially parallel to the first axis C1 and intersects the above-mentioned surface at a position between an edge of the surface A and the center of the surface A.

Further, the housing 60 of the present invention may be composed of several housing units. For example, the housing 60 may be formed with housing units 60A, 60B, and 60C connected to each other by any suitable connection mechanism, which may be conventional mechanism such as engagement, adhering, and fastening. In the embodiment shown in FIG. 3, the housing unit 60A is the main unit enclosing a chamber accommodating the lock core 10, the adapter 30 (described later), and part of the fastener 20, wherein the housing unit 60A may have a tubular shape or be formed as a cylinder. The cylinder-like housing unit 60A may extend along the first axis C1, and has an opening on the first axis as a through hole 610 for the fastener 20 to extend out of the housing unit 60A. The housing units 60B and 60C are further combined with the unit 60A to constitute an outline of the lock and for other applications such as covering holes formed on the housing unit 60A, forming a trough, facilitating holding/gripping convenience by having specific shape or texture, or allowing a flexible element 70 to be connected thereto. For example, the housing unit 60C is designed for the flexible element 70 such as a chain or a cable to be connected thereto. The lock may further include a connecting element 61. The connecting element 61 together with the fastener 20 is configured to engage with the lock hole 61 of the electronic device, wherein the connecting element 61 is preferably part of the housing 60. In the embodiment shown in FIG. 3, the connecting element 61 is a portion of the front end of the housing unit 60A and includes at least one confining pin 611, wherein the front end may be regarded as the end of the housing unit 60A where the fastener 20 extends out, or the end of the housing unit 60A that faces the electronic device 9 when the lock is connected to the electronic device 9. Preferably, the connecting element 61 of the present invention includes two separated confining pins 611 formed on a bottom surface 61A of the cylinder-like housing unit 60A, and the through hole 610 communicating with the chamber is formed therebetween. Two separated confining pins 611 are configured to confine the displacement of the fastener 20 in one dimension. In the present invention, as the embodiment shown in FIGS. 4A-4B, the extending rod 21 passes through the through hole 610 and extends along the confining pins 611, and the retaining portion 22 protrudes beyond distal ends of the confining pins 611. In addition, one end of the extending rod 21 other than the end connected to the retaining portion 22 is located in the chamber and connected to the lock core 10.

As above mention, the fastener 20 rotates about the second axis C2 that passes through the extending rod 21 (i.e. revolving on the extending rod's own axis), wherein the rotation is in coordination with the unlocking/locking operation of the lock core 10, the fastener 20 can enter the lock hole, cannot enter the lock hole, or can be fastened in the lock hole depending on the status after rotation. The retaining portion 22 rotates relative to the distal ends of the confining pins 611 along with the rotation of the fastener 20, wherein the extension direction thereof forms different included angles with a virtual connecting line L that connects the distal ends of the two confining pins 611. For example, when the lock core is unlocked, the fastener 20 may be operable to rotate from the status shown in FIG. 4B that the extension direction of the retaining portion 22 is parallel to the virtual connecting line L to the status shown in FIG. 4A that the extension direction of the retaining portion 22 is perpendicular to the virtual connecting line L. When the extension direction of the retaining portion 22 is parallel to the virtual connecting line L, the fastener 20 and the confining pins 611 of the connecting element 61 can be inserted into the lock hole or retreated therefrom. When the fastener 20 and the confining pins 611 of the connecting element for lock hole 61 have been inserted into the lock hole, the extension direction of the retaining portion 22 perpendicular to the virtual connecting line L is engaged with the lock hole. In addition, in the preferred embodiment of the present invention, along with the locking operation of the lock core 10, the retaining portion 22 is rotated from the status shown in FIG. 4B to the status shown in FIG. 4A. Similarly, the retaining portion 22 is rotated from the status shown in FIG. 4A to the status shown in FIG. 4B along with the unlocking operation of the lock core 10. In other embodiments, however, the locking/unlocking operation of the lock core 10 and the operation of the fastener 20 may proceed individually, wherein the rotation of the fastener 20 may be operated by such as a turning wheel or a button.

Further, the lock core 10 drives the fastener 20 to rotate through the adapter. As shown in FIG. 3, the adapter 30 includes a driving element 40 and a driven portion 50. The driving element 40 is disposed next to one end of the lock core 10 near the fastener 20, and the driven portion 50 is located at one end of the extending rod 21 other than the end connected to the retaining portion 22, wherein the driven portion 50 and the fastener 20 are preferably an integral piece. The driving element 40 and the driven portion 50 interactively contact each other, e.g. coupled and moveable relative to each other. In the embodiment shown in FIG. 3, specifically, the driving element 40 includes a columnar portion 41 and at least one pin 43. Preferably, the columnar portion 41 is substantially disposed on the lock core 10 along the above-mentioned second axis C2, and two pins 43 are formed on opposite sides of one end of the columnar portion 41 away from the lock core 10. With regard to the key lock, the lock core 10 of the embodiment of the present invention has a first lock core portion 11 and a second lock core portion 12 connected to the first lock core portion 11 along the above-mentioned first axis C1. The first lock core portion 11 and the second lock core portion 12 can together further be disposed in a lock shell 15, wherein the first lock core portion 11 may be such as a rotatable seat and is operable to rotate relative to the second lock core portion 12, which is, for example, a fixed seat. In addition, the lock core 10 composed of the first lock core portion 11 and the second lock core portion 12 may displace axially together with the lock shell 15. In addition, the second lock core portion 12 is near the fastener 20; the driving element 40 is disposed on the second lock core portion 12 and shifted away from the center thereof. The driving element 40 is coupled with the driven portion 50 located next to the fastener 20. The driving element 40 and the second lock core portion 12 may be an integral piece. When the lock core 10 moves along the first axis C1, the driving element 40 disposed thereon moves simultaneously.

Figure 5A:
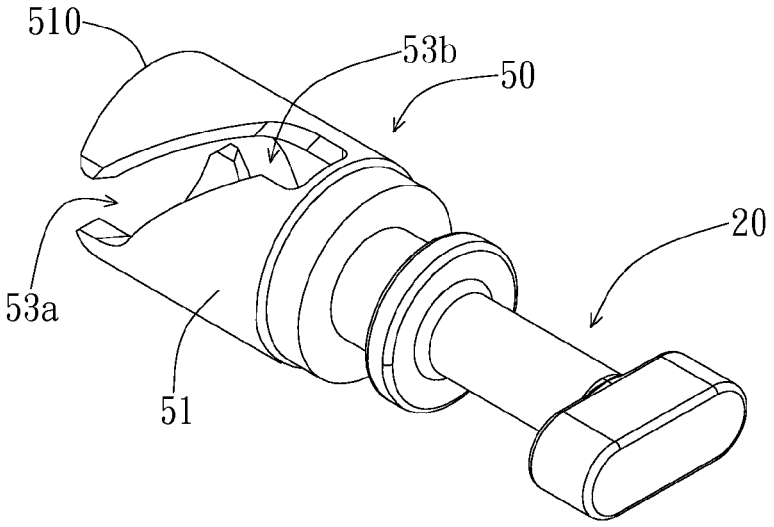
FIGS. 5A-5C are schematic views of the embodiment of the fastener and the driven portion of the lock of the present invention.
Figure 5B:
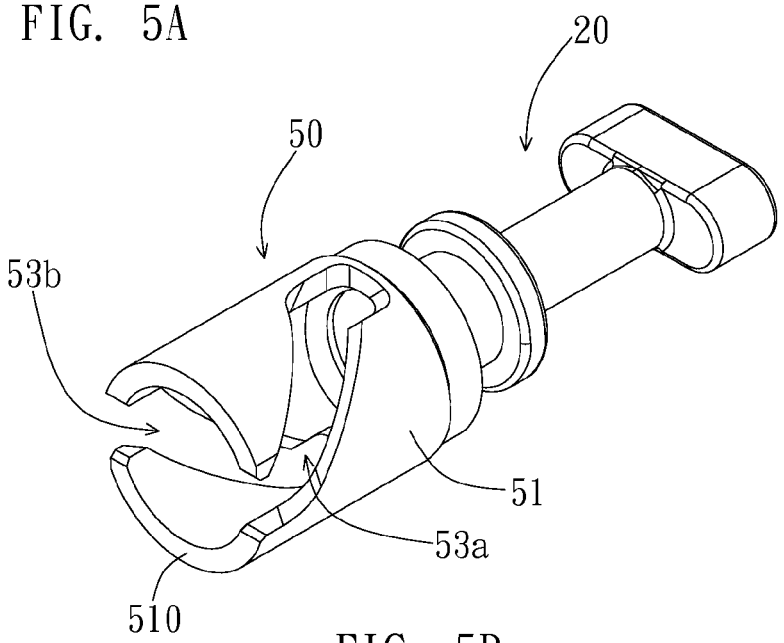
Figure 5C:
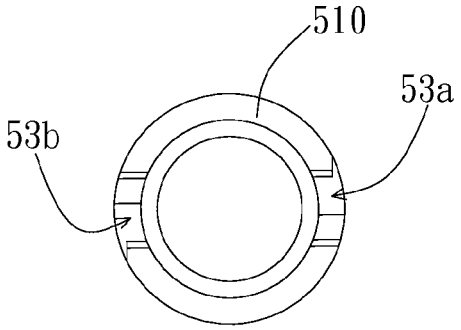
Figure 6A:
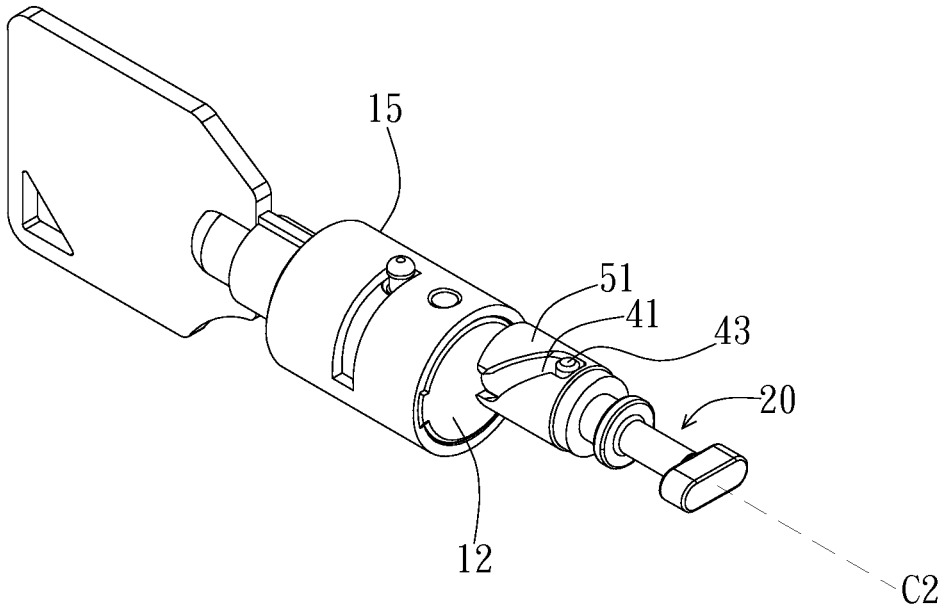
FIGS. 6A-6B are perspective views of the embodiment shown in FIGS. 2A-2B having the housing units partially removed.

As the embodiment shown in FIGS. 5A-5C, the driven portion 50 of the present invention includes a hollow column 51 corresponding to the columnar portion 41 of the driving element 40. The hollow column 51 has at least one guiding portion 53*a*. In the embodiment, the guiding portion 53*a* is a guiding groove formed by cleaving a wall of the hollow column 51 and obliquely extending from one end toward the other end. Specifically, the guiding portion 53*a* extends from one end of the hollow column 51, e.g. from a three o'clock position at the end 510 away from the fastener 20, toward a twelve o'clock position at the other end by about 45-degree oblique. In addition, it is preferred that two pins 43 are formed on the columnar portion 41. Another guiding portion 53*b* similar to the guiding portion 53*a* is formed on the hollow column 51 extending form the end 510 of the hollow column 51, at a nine o'clock position and opposite to the guiding portion 53*a*, toward a six o'clock position at the other end by about 45-degree oblique. In addition, as shown in FIGS. 6A-6B, the columnar portion 41 of the driving element 40 is axially moveably received in the hollow column 51 while the hollow column 51 is rotatable about the second axis C2 and surrounds the columnar portion 41; two pins 43 are moveably engaged with the guiding portions 53*a* and 53*b*, respectively, wherein the axial movement of the columnar portion 41 drives the pins 43 to move along the guiding portions 53*a* and 53*b*, and the pins 43 contact against walls of the guiding grooves to drive the hollow column 51 to rotate.

Figure 4A:
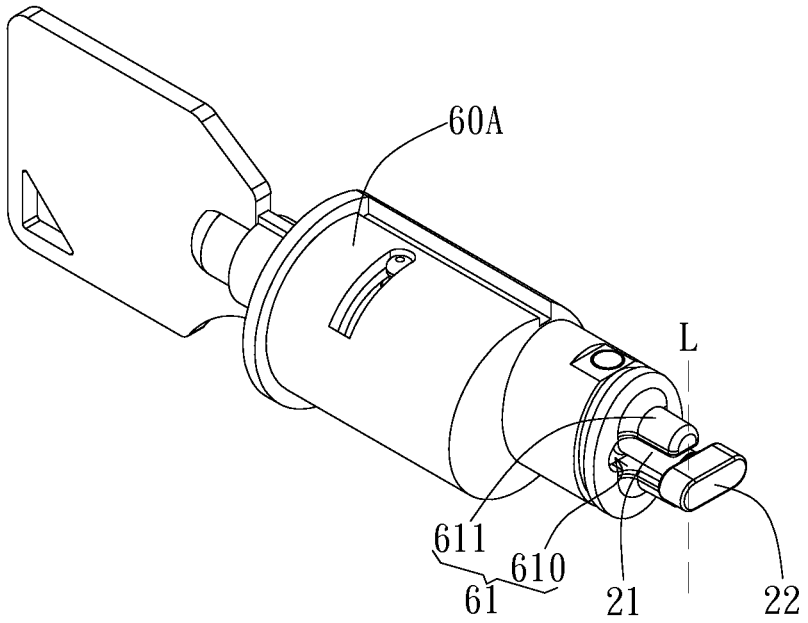
FIGS. 4A-4B are perspective views of the embodiment shown in FIGS. 2A-2B having the housing units partially removed.

As mentioned above, with regard to the key lock, the first lock core portion 11 is operable to rotate relative to the second lock core portion 12 about the first axis C1, and the lock core 10 composed of the first lock core portion 11 and the second lock core portion 12 may displace axially together with the lock shell 15. When the lock core 10 is locked, usually the lock core 10 is restricted to a restriction position in the housing 60. As FIG. 3 shows, a moveable pin 111 extends into a recess (not shown) formed on an inner wall of the housing unit 60A and is fixed therein. As a result, the lock core 10 is located at the restriction position relative to the housing 60 while the moveable pin 111 extends into the recess. Under a key's operation, the key drives the first lock core portion 11 to rotate relative to the second lock core portion 12 so as to release the lock core 10; accordingly, the lock core 10 can axially move away from the fastener 20 due to such as elasticity of an elastic element. Furthermore, please refer to FIGS. 6A and 6B in sequence, the driving element 40 moves away from the fastener 20 and drives the driven portion 50 to rotate by means of the above-mentioned mechanism; the fastener 20 connected with the driven portion 50 therefore rotates. In addition, as FIGS. 4A-4B show, the retaining portion 22 of the fastener 20 rotates from the status that the extension direction thereof is perpendicular to the virtual connecting line L of the connecting element 61 to the status that the extension direction thereof is parallel to the virtual connecting line L, so that the unlocking operation enables the fastener 20 and the confining pins 611 of the connecting element 61 to be inserted into or retreated from the lock hole.

Figure 4B:
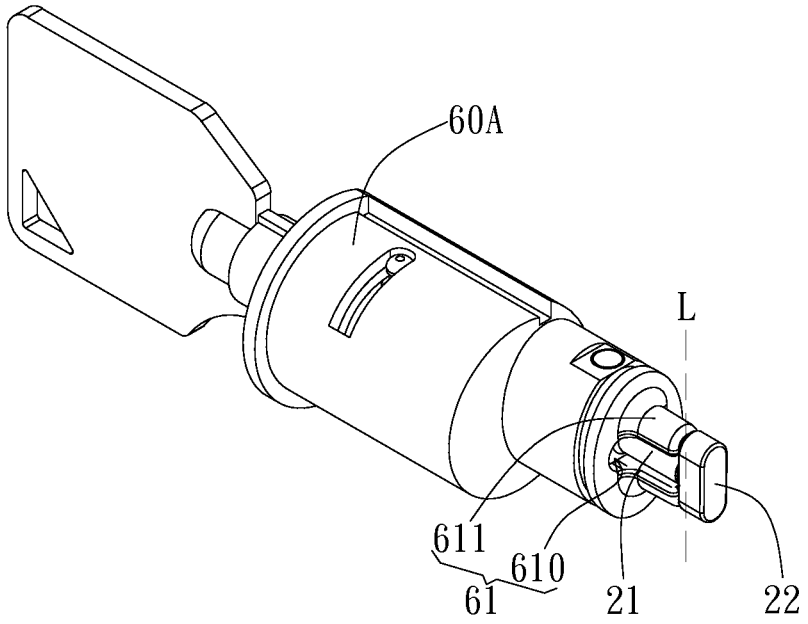
Figure 6B:
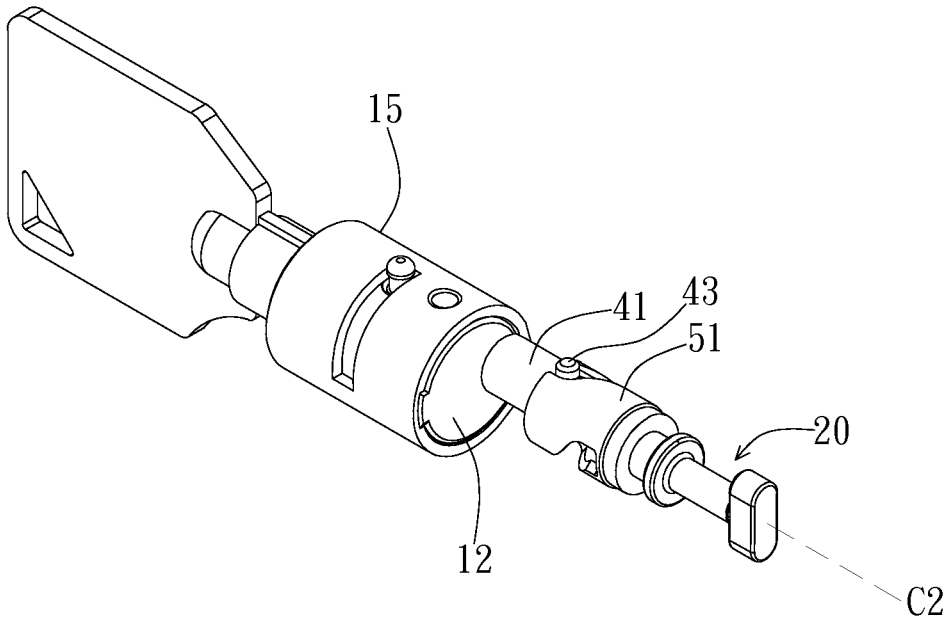

On the other hand, with regard to the key lock embodiment, pressing the lock core 10 shown in FIG. 4B or 6B makes the lock core 10 move toward the fastener 20 and arrive the restriction position, i.e. the moveable pin 111 extends into the recess again and the lock is locked. Meanwhile, as FIG. 6B and then 6A show, the driving element 40 on the lock core 10 moves toward the fastener 20 and drives the driven portion 50 to rotate, the fastener 20 connected with the driven portion 50 therefore rotates. The retaining portion 22 of the fastener 20 rotates from the status that the extension direction thereof is parallel to the virtual connecting line L of the connecting element 61 to the status that the extension direction thereof is perpendicular to the virtual connecting line L, so that the locking operation enables the retaining portion 22 to be secured in the lock hole when the fastener 20 and the confining pins 611 of the connecting element for lock hole 61 have entered the lock hole.

Figure 7A:
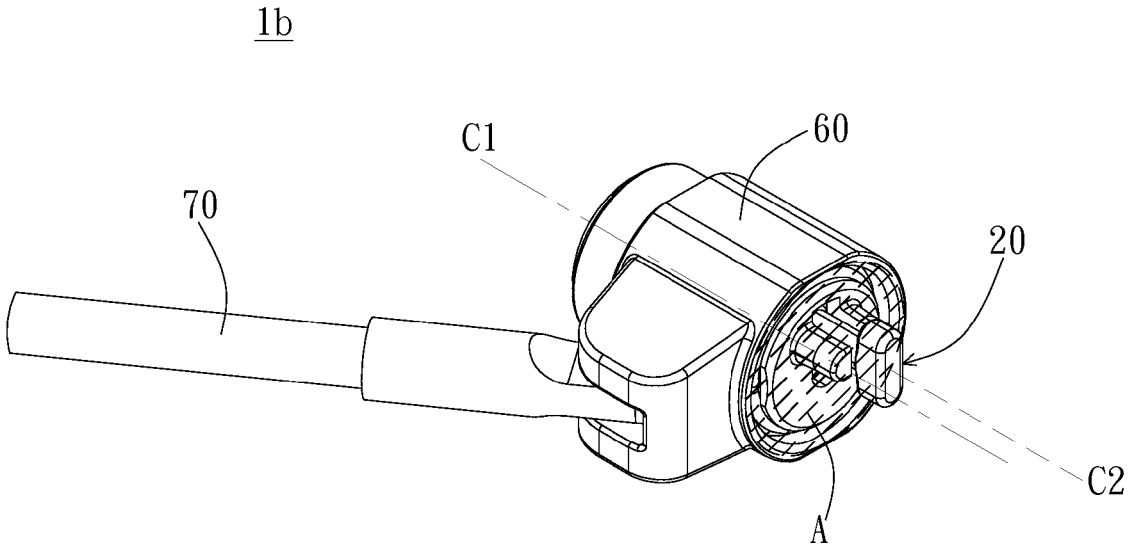
FIGS. 7A-7B are a perspective view and a front view of another embodiment of the lock of the present invention.
Figure 7B:
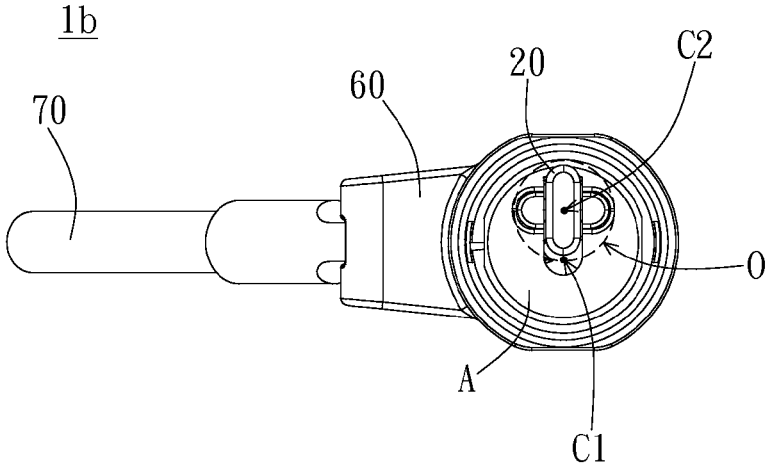
Figure 8:
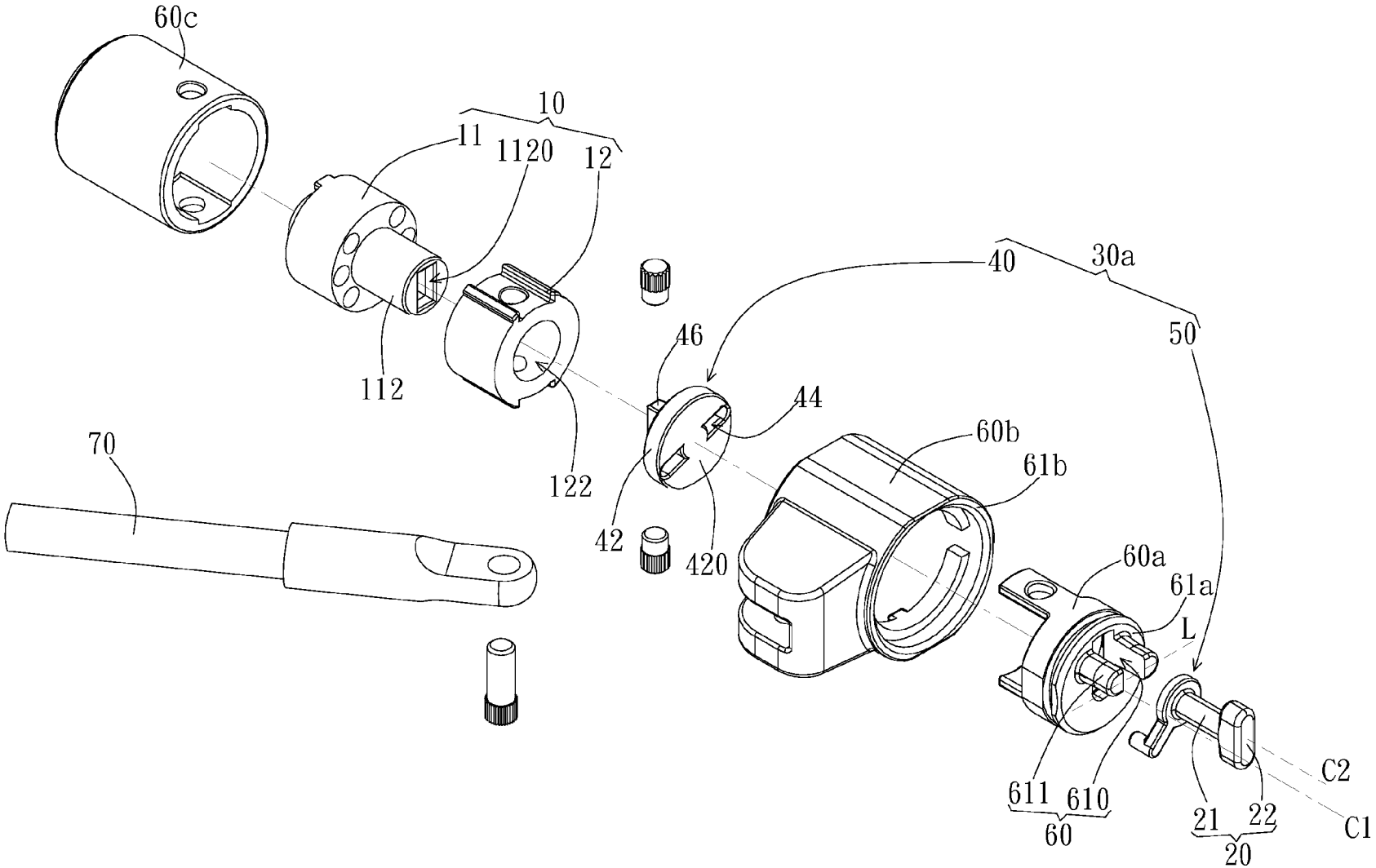
FIG. 8 is an exploded view of the embodiment shown in FIGS. 7A-7B.

In another embodiment of the present invention, as FIGS. 7A-7B and 8 show, the lock core 10 of the lock 1*b* is operable and rotatable about the first axis C1 passing therethrough, for example, being rotated about the first axis C1 and unlocked under the key's operation. In addition, in accordance with the usual setting of the lock core 10 inside a lock, the first axis C1 is not only the central axis of the lock core 10 but preferably also the central axis of the lock 1*b*. The lock 1*b* also includes the housing 60, the fastener 20, and the adapter 30. The fastener 20 partially protrudes out of the housing 60 and is provided for being connected to the lock hole of the electronic device. The fastener 20 is substantially connected with the lock core 10 in the extension direction of the lock core 10 and is shifted away from the first axis C1. For example, as FIG. 7A-7B show, the fastener 20 protrudes out of the surface A of the housing 60 and is shifted away from the first axis C1 and the center of the surface A.

Figure 9A:
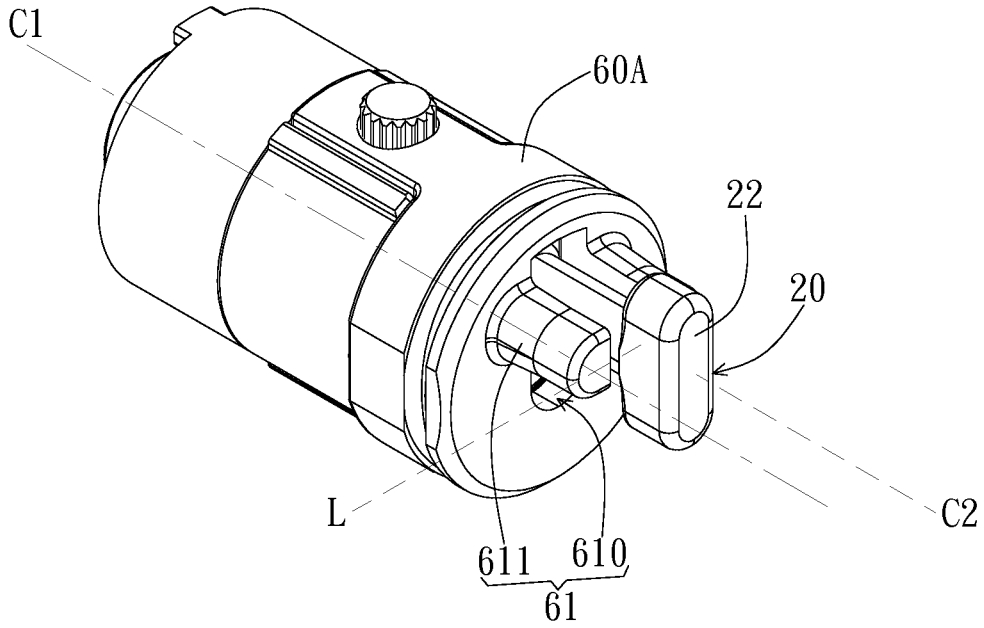
FIGS. 9A-9B are perspective views of the embodiment shown in FIGS. 7A-7B having the housing units partially removed.
Figure 9B:
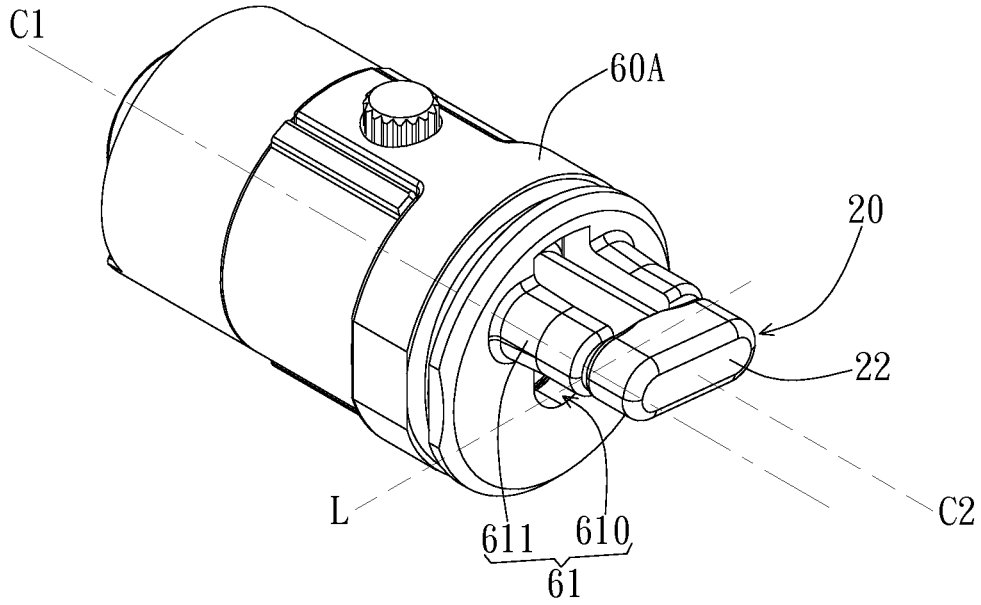

Other features of the hosing 60 and the fastener 20 are similar to those described above and will not be elaborated. As FIGS. 9A-9B show, along with the locking operation of the lock core 10, the retaining portion 22 is rotated from such as the status shown in FIG. 9B to the status shown in FIG. 9A, i.e. from the status of being parallel to the virtual connecting line L to the status of being perpendicular to the line L. Similarly, along with the unlocking operation of the lock core 10, the retaining portion 22 is rotated from such as the status shown in FIG. 9A to the status shown in FIG. 9B, i.e. from the status of being perpendicular to the virtual connecting line L to the status of being parallel to the line L. In addition, in the embodiment, the housing 60 is formed with housing units 60*a*, 60*b*, and 60*c*, wherein the connecting element 61 protrudes from an outer surface 61*a* of the housing unit 60*a*.

Figure 10A:
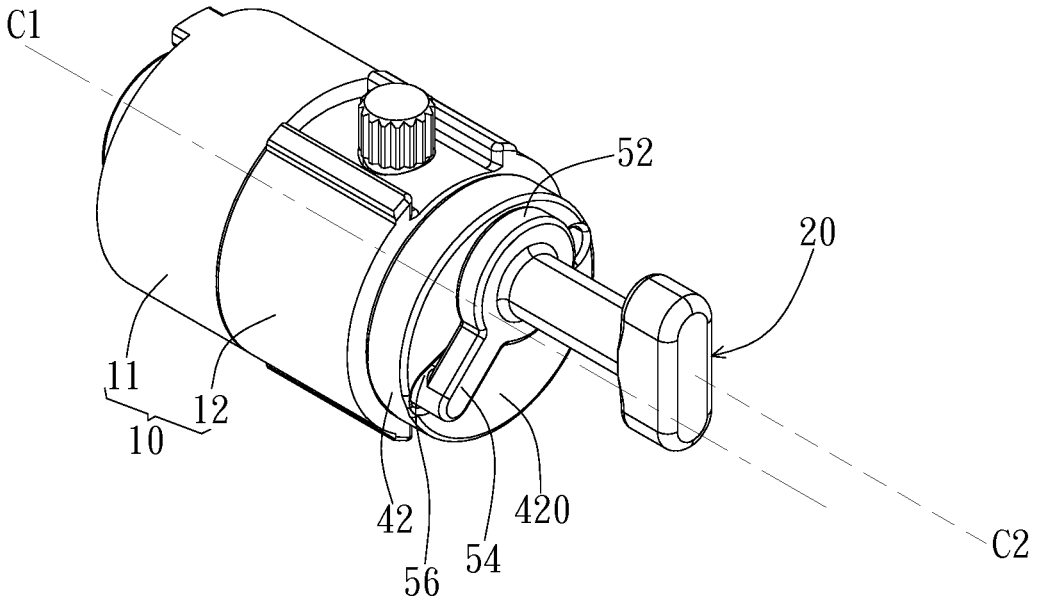
FIGS. 10A-10B are a perspective view and a front view of the embodiment shown in FIGS. 7A-7B having the housing units partially removed.
Figure 10A:
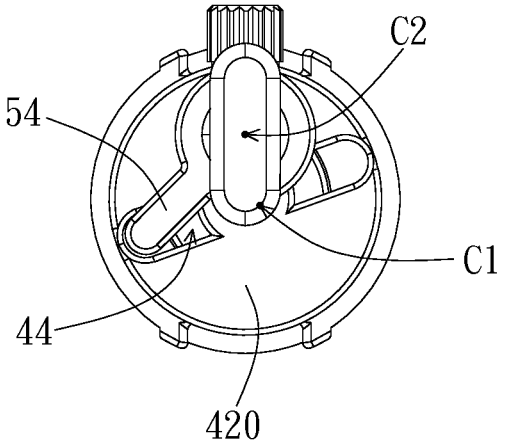
Figure 10B:
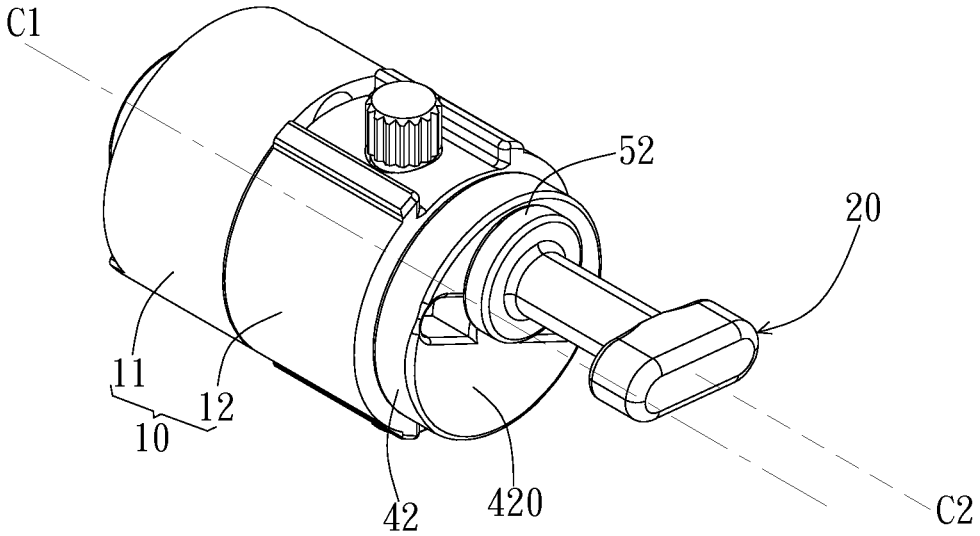
Figure 10B:
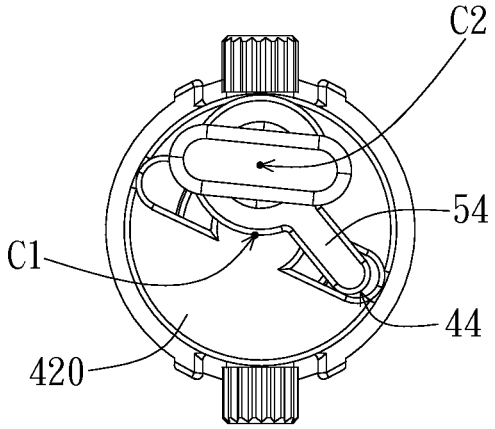

The lock core 10 of the lock 1*b* also drives the fastener 20 to rotate by means of the adapter 30. As shown in FIG. 8, the adapter 30 includes the driving element 40 and the driven portion 50. The driving element 40 is disposed next to one end of the lock core 10 near the fastener 20; the driven portion 50 is located at one end of the extending rod 21 other than the end connected to the retaining portion 22, wherein the driven portion 50 and the fastener 20 are preferably an integral piece. The driving element 40 and the driven portion 50 interactively contact each other, e.g. coupled and moveable relative to each other. In the embodiment shown in FIG. 8, specifically, the driving element 40 includes a plate 42. As FIGS. 10A-10B show, the plate 42 is disposed on the lock core 10 and has a plate surface 420 facing away from the lock core 10, wherein the first axis C1 of the lock core 10 substantially passes through the center of the plate 42. In addition, at least one hole 44 shifted away from the first axis C1 is formed on the plate 42. Similar to the previous embodiment, the lock core 10 of the lock 1*b* has the first lock core portion 11 and the second lock core portion 12, wherein the first lock core portion 11 is such as a rotatable seat and is operable to rotate relative to the second lock core portion 12, which is, for example, a fixed seat. In addition, in the present embodiment, the first lock core 11 of the lock 1*b* further has a jointer 112 such as a post, and the second lock core 12 has a penetration hole 122. The penetration hole 122 has an outline corresponding to the jointer 112, and the second lock core portion 12 is connected to the first lock core portion 11 by means of inserting the jointer 112 into the penetration hole 122. The plate 42 further has an engaging element 46 formed on a side facing the lock core 10 for engagement with a hole 1120 formed on an end of the jointer 112. Accordingly, the first lock core portion 11 will drive the plate 42 disposed thereon to rotate when the first lock core portion 11 rotates relative to the second lock core portion 12.

Figure 11A:
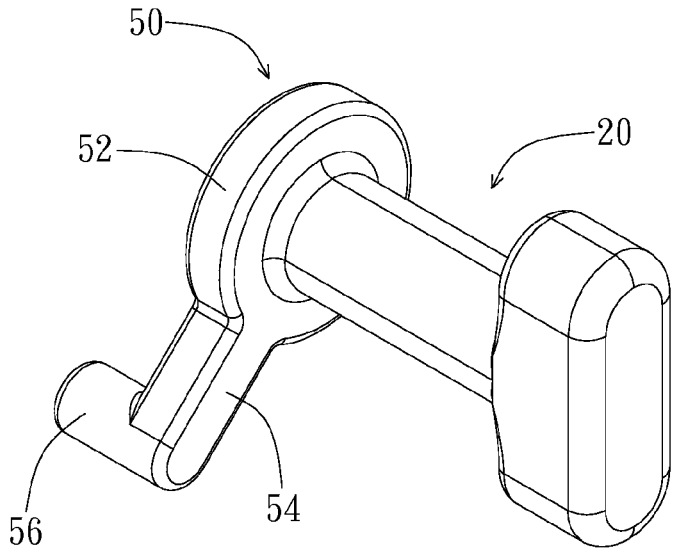
FIGS. 11A-11B are perspective views of another embodiment of the fastener and the driven portion of the lock of the present invention.
Figure 11B:
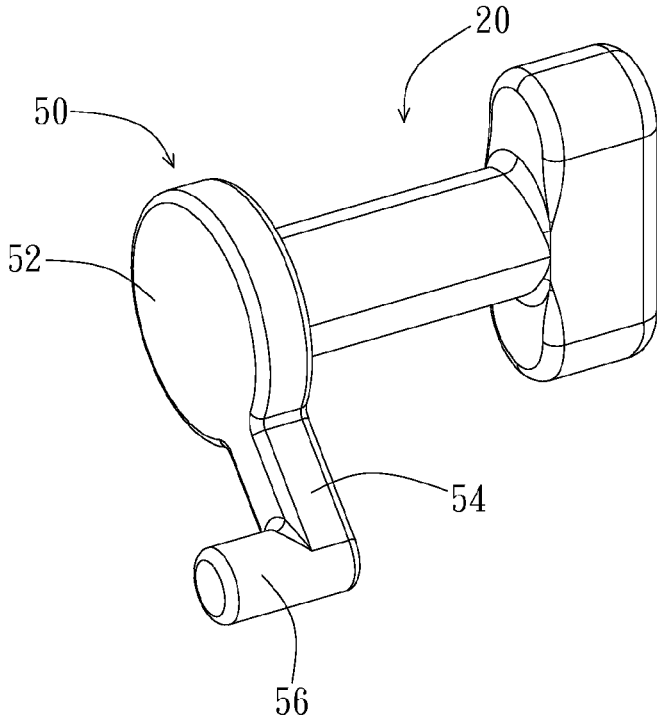

As FIGS. 11A-11B show, the driven portion 50 of the lock 1*b* may include a slab 52, a push rod 54 extending from an edge of the slab 52 and parallel to the slab 52, and a protrusion 56 protruding from one end of the push rod 54 and away from the fastener 20, wherein the slab 52 is attached to the surface 420 of the plate 42, and the protrusion 56 is moveably arranged in the hole 44, as shown in FIGS. 10A-10B. When the first lock core portion 11 drives the plate 42 to rotate about the first axis C1, the hole 44 also rotates about the first axis C1, wherein a wall of the hole 44 contacts against the protrusion 56 and drives the push rod 54 to move parallelly to the surface 420 in a way that the end of the push rod 54 having the protrusion 56 moves farther than the other end connected to the slab 52. The push rod 54 drives the slab 52 and the fastener 20 to rotate, wherein the fastener 20 preferably rotates about the second axis C2.

When the lock core 10 of the lock 1*b* is in the locked state and operated by the key, the first lock core portion 11 may rotate relative to the second lock core portion 12. As FIG. 10A and then FIG. 10B show, the driving element 40 disposed on the lock core 10 is driven through the above-mentioned mechanism to drive the driven portion 50 to rotate, the fastener 20 connected with the driven portion 50 accordingly rotates. In addition, as FIG. 9A and then FIG. 9B show, the retaining portion 22 is rotated from the status of being perpendicular to the virtual connecting line L to the status of being parallel to the line L, so that the fastener 20 and the confining pins 611 of the connecting element 61 can be inserted into or retreated from the lock hole. On the other hand, the locking operation of the lock 1*b* is achieved by the key driving the first lock core portion 11, which also rotates relative to the second lock core portion 12, wherein the rotation direction is counter to a direction when unlocking. In addition, as FIG. 9B and then FIG. 9A show, the retaining portion 22 of the fastener 20 rotates from the status of being parallel to the virtual connecting line L of the connecting element 61 to the status of being perpendicular to the virtual connecting line L so that the locking operation enables the retaining portion 22 to be secured in the lock hole.

In other embodiments of the present invention, the lock is not limited to a key lock; the fastener is not limited to having a T shape and being rotatable. The lock includes the housing 60 and a lock core, wherein an outer surface of a side of the housing 60 serves as a first surface A. When the lock is connected to the electronic device, the first surface A of the lock faces the electronic device and may contact a surface of the electronic device having the lock hole formed thereon. In addition, at least a portion of the fastener protrudes out of the housing 60 from the first surface A and is shifted away from the center of the first surface A.

In the meanwhile take the embodiment shown in FIGS. 2A-2B and FIG. 3 for an example, the cylinder-like housing unit 60A includes a first portion 601 with a smaller diameter and a second portion 602 with a greater diameter, wherein the above-mentioned first axis C1 substantially equal to the central axis of the second portion 602; the first portion 601 is shifted away from the center of the second portion 602 and has its central axis substantially at the above-mentioned second axis C2. Furthermore, the above-mentioned bottom surface 61A is located at the first portion 601, wherein the confining pins 611 protrude on the bottom surface 61A. The confining pins 611 and the through hole 610 may be located around the center of the bottom surface 61A while the fastener is shifted away from the first axis C1 and substantially located at the second axis C2. The smaller the bottom surface 61A is, the closer the confining pins 611 to an edge of the bottom surface 61A will be; the fastener is accordingly shifted away from the first axis C1 and close to the edge of the bottom surface 61A.

In the embodiment shown in FIGS. 2A-2B and FIG. 3, the housing unit 60B may be disposed at the step difference between the first portion 601 and the second portion 602; the housing unit 60B may be designed to have a protrusion 63B for allowing the flexible element 70 to be connected thereto. For example, the housing unit 60B may have a C shape and is aside to first portion 601 and combined therewith. The housing unit 60B has a surface 61B; when the housing unit 60B is combined with the first portion 601, the surface 61B and the bottom surface 61A are substantially coplanar and together constitute the main portion or all of the above-mentioned first surface A.

Accordingly, the fastener 20 shifted away from the first axis C1 is shifted away from the center of first surface A. The second axis C2 passes through the extending rod 21 and intersects the first surface A at a position P2 between the center and an edge of the first surface A. Comparatively, the lock core, i.e. a rotation axis of the first lock core portion, passes the center of the first surface A. That is, the distance between the position P2 and the edge at one side of the first surface A is different from the distance between the position P2 and the edge at the opposite side thereof, wherein in the embodiment shown in FIGS. 2A-2B and FIG. 3, the edge portion closest to the position P2 is substantially located at the bottom surface 61A, wherein preferably, a connecting line of the edge at the opposite sides passes the center of the first surface A and the position P2, at which the second axis C2 intersects the first surface A. In addition, referring to FIGS. 2A-2B or 7A-7B, the retaining portion 22 rotates about the second axis C2 in a circular area O, the virtual circle projects on the first surface A and the circumstance thereof partially intersect the edge of the first surface A. However, in other embodiments, the fastener may be shifted farther away from the center of the first surface A; in such circumstance, the retaining portion may protrude out of the first surface A.

Figure 12A:
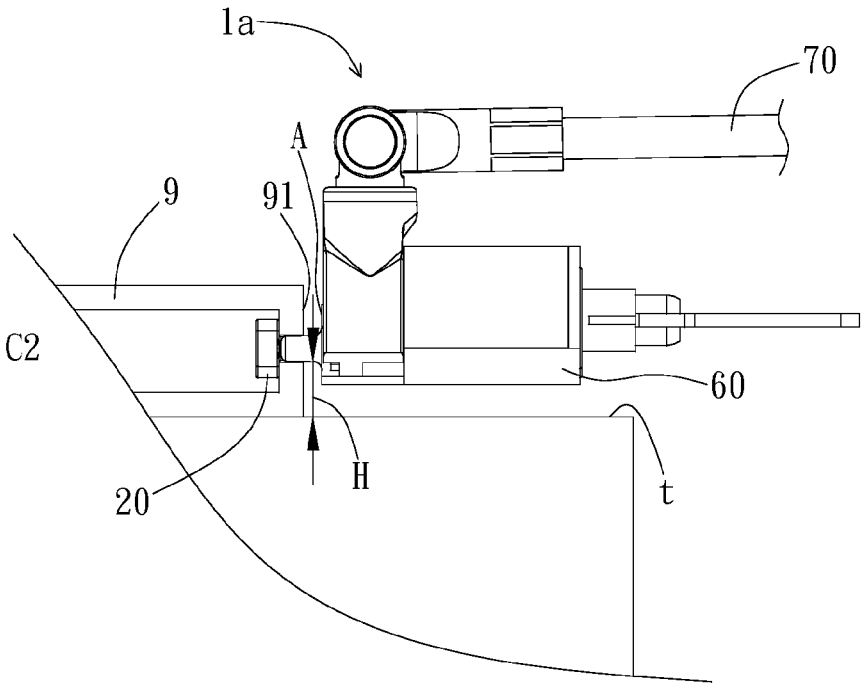
FIGS. 12A-12B are perspective views of the embodiment of the lock of the present invention provided for electronic devices.
Figure 12B:
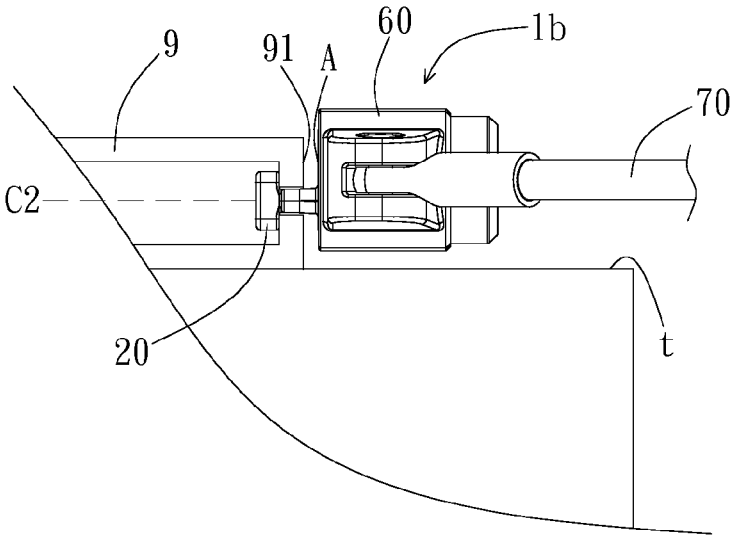

When the lock 1*a* or lock 1*b* of the present invention is used for the electronic device 9, as FIGS. 12A-12B show, since the fastener 20 is shifted away from the center of the first surface A, the distance between the fastener 20 and the edge of a side of the first surface A is shorter, and the connection of the fastener 20 and the lock hole therefore will not affect a status of the electronic device 9 lying on the supporting face t. That is, in the present invention, the position of the fastener on the first surface A may be designed based on the thickness of the electronic device 9 or the height of the side 91 thereof. For example, the shortest distance between the fastener and the edge of the first surface A such as the edge of the bottom surface 61A is smaller than a height H of the lock hole of the electronic device 9.

In addition, take the embodiment shown in FIGS. 7A-7B and FIG. 8 for an example, the outer surface 61*a* of the housing unit 60*a* constitutes the main portion of the first surface A; an end edge of the housing unit 60*b* and an end edge of the housing unit 60*c* (e.g. 61*b*) surround the housing unit 60*a* and constitute a minor portion of the first surface A. The first axis C1 meanwhile passes the center of the outer surface 61*a*; the through hole 610 is preferably formed to shift away from the center of the outer surface 61*a* while the fastener 20 is shifted away from the first axis C1, wherein there is a shorter distance between an edge of a side of the first surface A and the fastener. For example, the shorter distance is between the fastener 20 and the end edge 61*b* of the housing unit 60*b*.

On the other hand, in the embodiment shown in FIGS. 13A-15C, the fastener 20*a* of the lock 1*c* includes a plurality of lever arms 24. Each of the lever arms 24 has a pivot 241, an effort arm 242 beside the pivot 241, and a resistance arm 243 beside the pivot 241 and opposite to the effort arm 242. Preferably, the effort arm 242, the pivot 241, and the resistance arm 243 can constitute a flat V shape (wherein the pivot 241 is at the bottom of the V shape) so that the a free end of the effort arm 242 and a front end of the resistance arm 243 have a longer displacement. In the preferred embodiment of the present invention, the effort arm 242, similar to the above-mentioned driven portion 50, is driven by the driving element 40.

The number of the lever arms 24 is not limited. For example, the number could be two, three, four, five, etc. (two lever arms 140 are shown in the figure). It is preferred that the lever arms 140 evenly surround a virtual axis Cv, which substantially equals to the axis of the fastener 20*a*. Meanwhile, the pivots 241 are close to each other and surround the virtual axis Cv; the effort arms 242 are at the same orientation (i.e., toward the same direction along the virtual axis Cv) and the resistance arms 243 are at the same orientation, respectively. In the embodiment that there are two lever arms 24, wherein the two lever arms 24 are symmetrically disposed at the opposites sides of the virtual axis Cv. The virtual axis in the embodiment is equal to the above-mentioned second axis C2. However, instead of rotating about the second axis C2, the fastener 20*a* has its effort arm 242 or the resistance arm 243 moving toward or away from the second axis C2 under a lever action, wherein a side of the lever arm 140 facing the second axis C2 is defined as an inner side while the opposite side thereof is defined as an outer side. In addition, as mentioned above, in the embodiment shown in FIGS. 13A-15C, the second axis C2 intersects the first surface A at the position between the edge and the center of the first surface A. In other words, the fastener 20*a* is shifted away from the center of the first surface A, wherein at least a portion of the fastener 20*a*, which includes at least a portion of the resistance arms 243 and protrusions 247 (described later) thereof, preferably protrudes out of the housing 60 from the first surface A.

On the other hand, the outer side of the front end of the resistance arm 243 has a protrusion 247 formed thereon. When the resistance arms 243 move toward the second axis C2 and the front ends thereof approach each other, the protrusions 247 also gather at the second axis C2, so that the fastener 20*a* is able to enter or leave the lock hole. On the contrary, when the resistance arms 243 move away from the second axis C2 and the front ends thereof spread from the second axis C2 thereof radially to get away from each other, the fastener 20*a* accordingly is unable to enter the lock hole. Alternatively, the fastener 20*a* is secured in the lock hole, wherein the protrusion 247 forms a hook portion 249 to contact against the wall around the lock hole of the electronic device.

Preferably, the movement of the fastener 20*a* such as the effort arm 242 or the resistance arm 243 moving toward or away from the second axis C2 may be controlled by an elastic body 25 disposed between the effort arms 242 and/or driving element 40. In the embodiment of the present invention, the elastic body 25 may be a torsional spring made of steel wire or elastic bead made of rubber, which applies force to the effort arms 242 evenly so that the free ends of the effort arms 242 are distant from each other, i.e. the front ends of the resistance arms 243 approach each other. On the other hand, as FIGS. 14A-15C show, the driving element 40 may be disposed on a side of the lock core 10 next to the fastener 20*a* and has a U-shaped structure 47. The driving element 40 may move along or parallel to the first axis C1 and toward the effort arms 242 so that the U-shaped structure 47 gathers the effort arms 242 therein, i.e. makes the resistance arms 243 move away from the second axis C2 and the front ends thereof spread radially form the second axis C2.

Figure 16A:
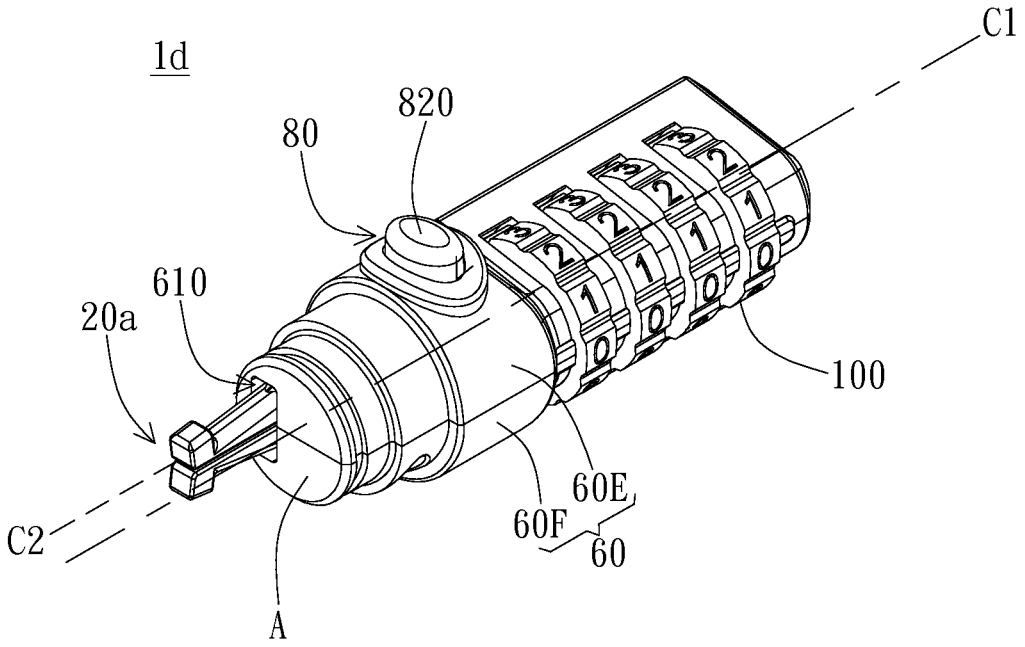
FIG. 16A is a perspective view of another embodiment of the lock of the present invention.
Figure 16B:
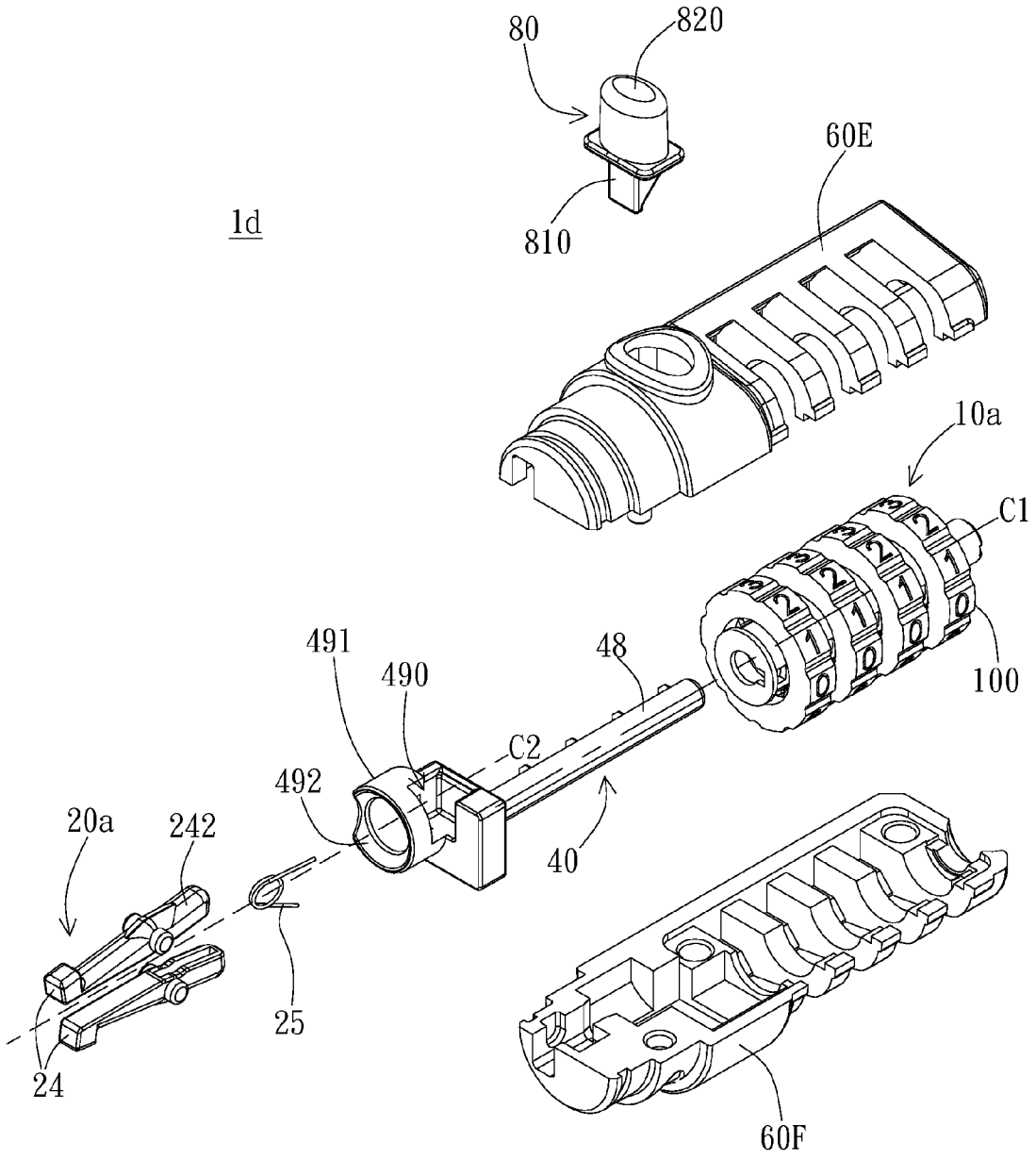
FIG. 16B is an exploded view of the embodiment shown in FIG. 16A.

In the embodiment shown in FIGS. 16A-16B, the lock is a combination lock. The lock 1*d* has the above-mentioned fastener 20*a* and a lock core of combination lock 10*a*. In addition, in the present embodiment, the lock 1*d* may further include an operating device 80 for such as operating the fastener 20*a* when the lock core is unlocked. As mentioned above, the plurality of lever arms 24 of the fastener 20*a* are symmetrically disposed asides the second axis C2, wherein the second axis C2 intersects the first surface A at the position between the edge and the center of the first surface A, i.e. the fastener 20*a* is shifted away from the center of the first surface A.

In the present embodiment, the driving element 40 of the lock 1*d* may includes a shaft, which may be regarded as part of the lock core 10*a* and cooperate with dials 100 to achieve unlocking or locking operation. For example, when the lock core 10*a* is unlocked, the shaft 48, i.e. the driving element 40 may move along the first axis C1; the first axis C1 is the central axis of the shaft 48 and the lock core 10*a*, and is preferably the central axis of the lock 1*d*. In addition, the driving element 40 has an enlarged structure formed at one end of the shaft 48, which includes a tube 491 and has a slot 490 formed thereon. The tube 491 is preferably a cylindrical tube and has one end facing the fastener 20*a*. An inner side of the end of the tube 491 that faces the fastener 20*a* is formed as an inner wall 492 of a funnel, which has a diameter become smaller and smaller along the direction away from the fastener 20*a* and serves as a guiding surface. The tube 491 and the inner wall 492 thereof are shifted away from the shaft 48, i.e. shifted away from the first axis C1, and correspond to two effort arms 242 of the two lever arms 24. That is, the center axis of the tube 491 is not aligned with the center axis of the shaft 48, i.e. the first axis C1. When the driving element 40 is able to move along the first axis C1 (i.e. the lock core 10*a* is unlocked), the tube 491 may move toward the fastener 20*a* so that the effort arms 242 are guided by the inner wall 492 to come closer to each other in the tube 491; meanwhile, the resistance arms 243 move away from the second axis C2, wherein the front ends thereof spread radially from the second axis C2.

On the other hand, the operating device 80 may have structure such as button, knob, switch, or rotary disc exposed for the user touching and operating. Additionally, the operating device 80 may have a driving portion 810. In the embodiment, the operating device 80 has the driving portion 810 formed as a wedge block for interacting with the driving element 40. Specifically, the wedge block 810 corresponds to the above-mentioned slot 490 and at least partially received in the slot 490. An oblique plane of the wedge block 810 preferably contacts against an inner wall of the slot 490. For example, when the driving element 40 moves along the first axis C1 (i.e. the lock core 10*a* is unlocked), a displacement of the wedge block 810, which is substantially perpendicular to the first axis C1 and toward the slot 490, enables the oblique plate to push the inner wall of the slot 490 so that the driving element 40 is driven to move along the first axis C1 and away from the fastener 20*a*. Therefore, the tube 491 releases the effort arms 242, and the elastic body 25 allows the free ends of the effort arms 242 move away from each other while the front ends of the resistance arms 243 approach each other.

Figure 13A:
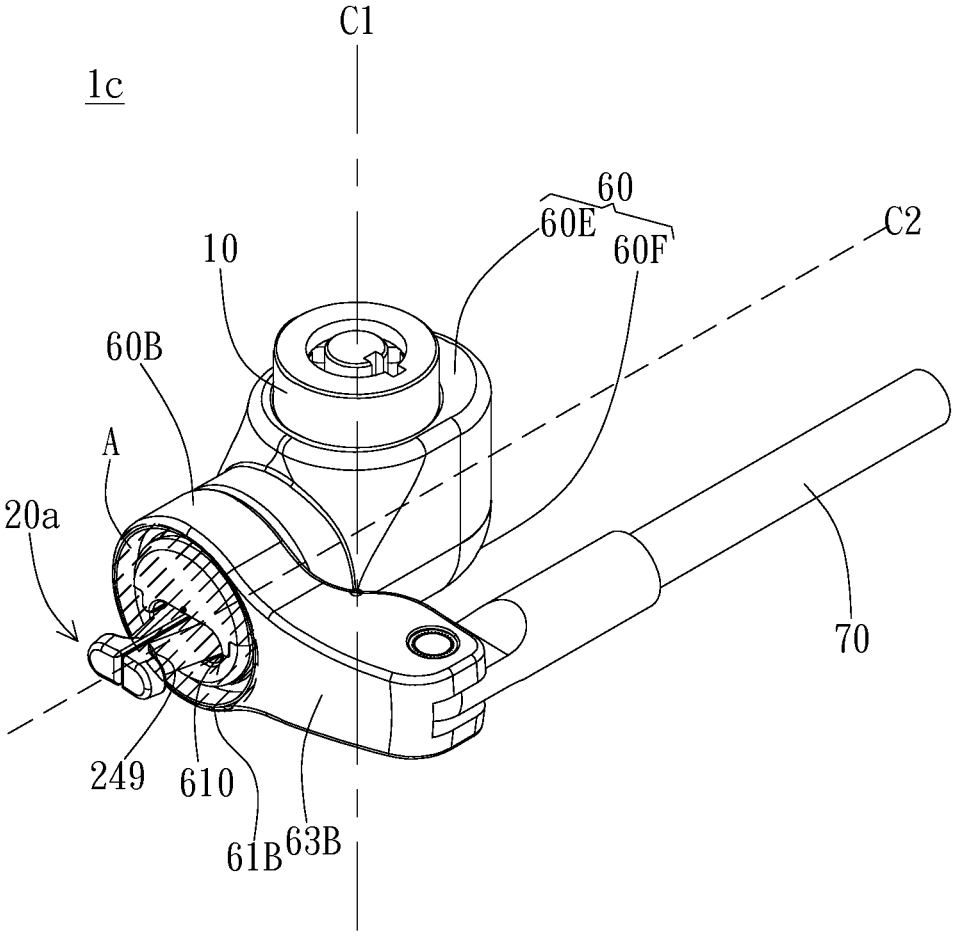
FIG. 13A is a perspective view of another embodiment of the lock of the present invention.
Figure 13B:
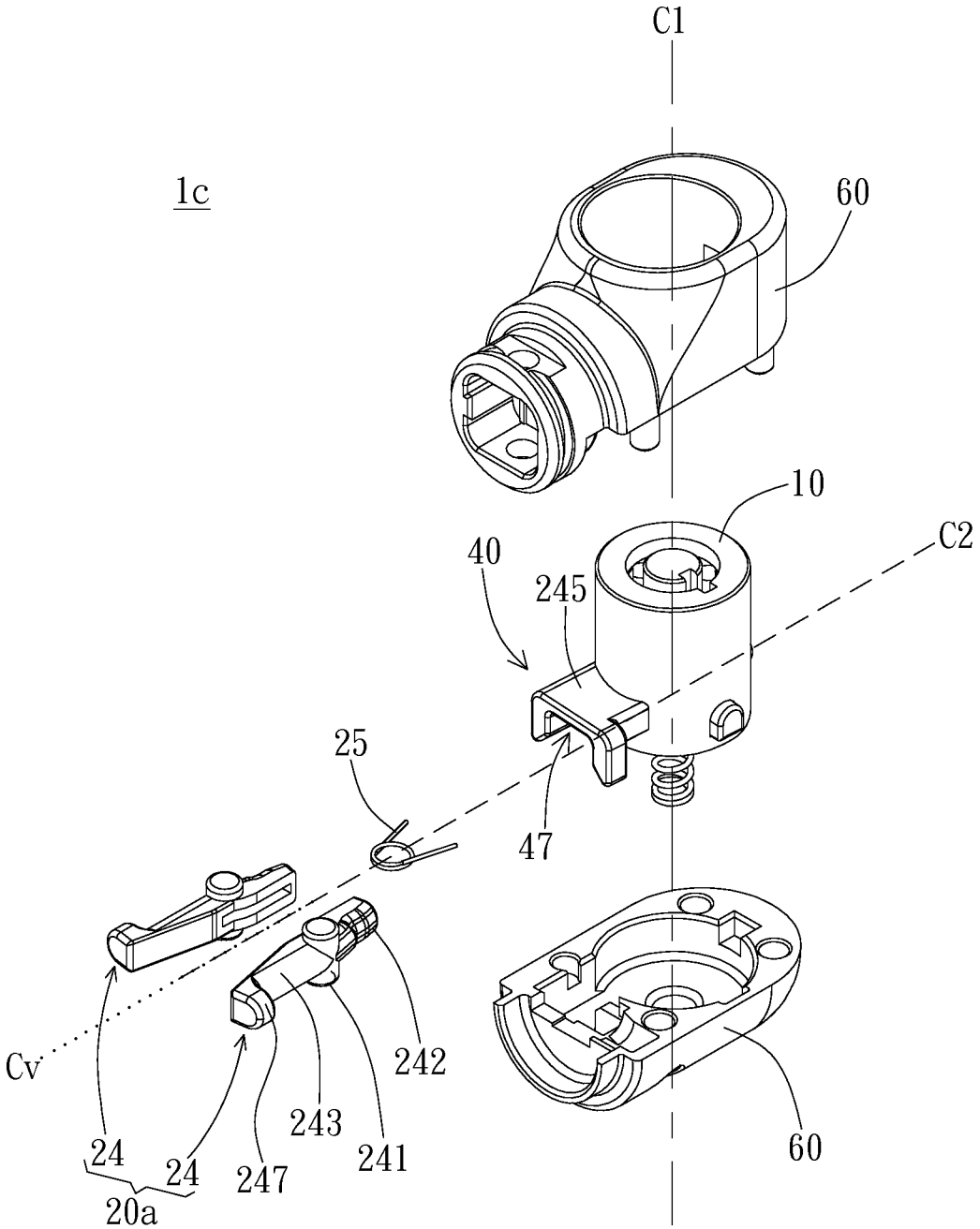
FIG. 13B is an exploded view of the embodiment shown in FIG. 13A.
Figure 14A:
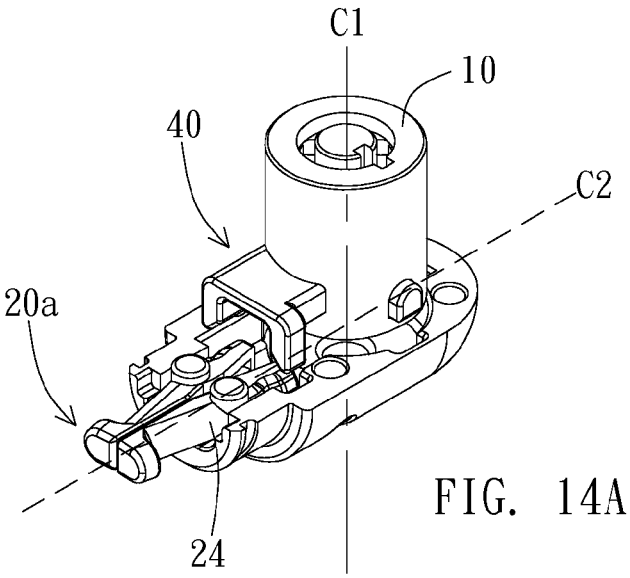
FIGS. 14A-14C and 15A-15C are perspective views of the embodiment shown in 13A having the housing units partially removed.
Figure 14B:
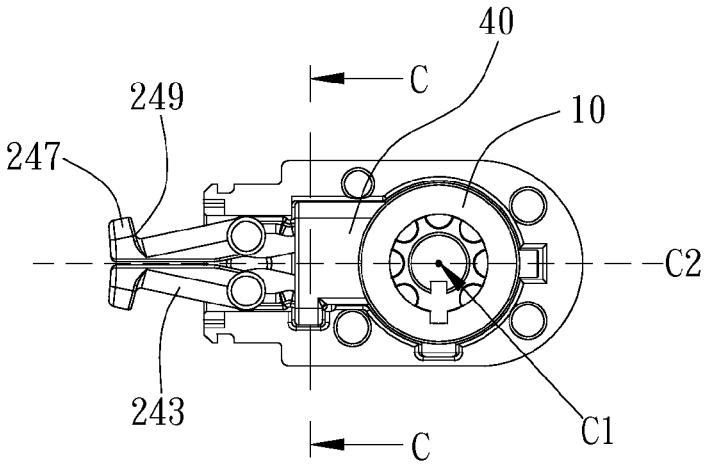
Figure 14C:
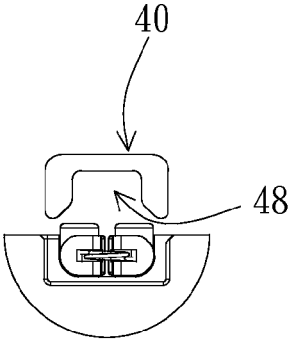
Figure 15A:
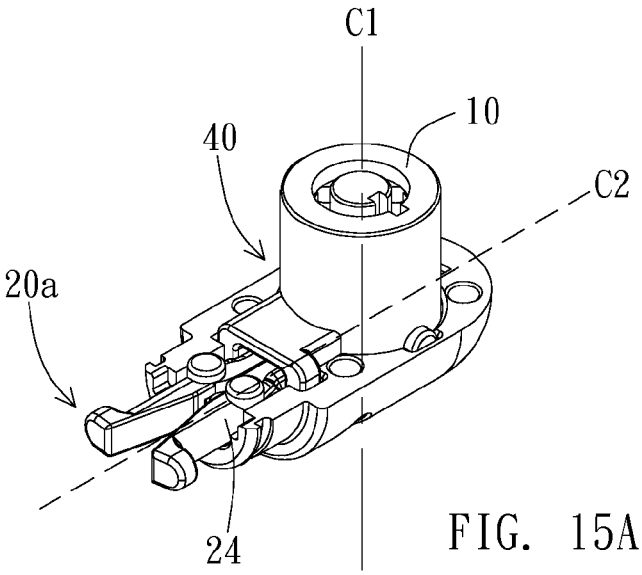
Figure 15B:
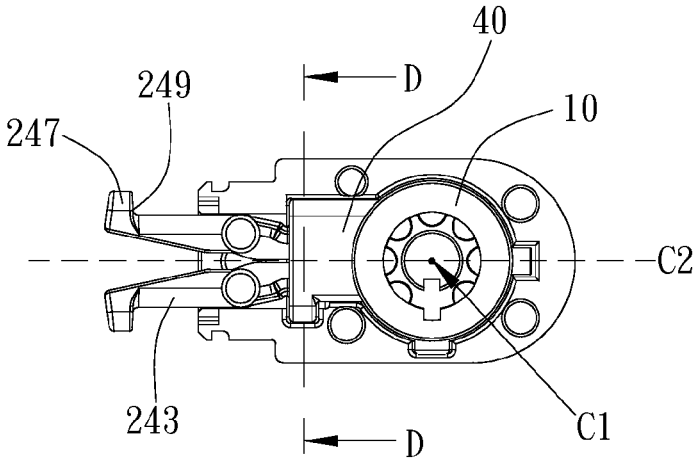
Figure 15C:
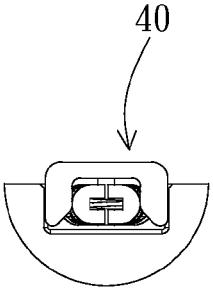

It may be noticeable that in the embodiment shown in FIGS. 13A-13B and FIGS. 16A-16B, the housing 60 may be composed of two housing units 60E and 60F facing each other. The combination of the housing units 60E and 60F constitute the main portion (as FIGS. 13A-13B show) or all (as FIGS. 16A-16B show) of the first surface A. In addition, the combination of the housing units 60E and 60F may form the through hole 610 for the fastener 20*a* to protrude out of the housing 60. In the embodiment shown in FIGS. 13A-13B, an end edge of the housing unit 60B (such as 61B) constitutes a minor portion of the first surface A; meanwhile, there is a shorter distance between the fastener 20*a* and an edge of a side of the first surface A of the fastener 20*a*, wherein the edge of the side is usually located at the end edge 61B of the housing unit 60B.

Although the preferred embodiments of present invention have been described herein, the above description is merely illustrative. The preferred embodiments disclosed will not limited the scope of the present invention. Further modification of the invention herein disclosed will occur to those skilled in the respective arts and all such modifications are deemed to be within the scope of the invention as defined by the appended claims.

What is claimed is:

1. A lock for an electronic device having a lock hole, comprising:

a lock core operable and rotatable about a first axis;

a fastener connected to the lock core;

wherein the fastener includes at least two V-shaped like lever arms disposed at two opposite sides of a virtual axis and move respectively at each side of the virtual axis, each of the lever arms includes a pivot, an effort arm and a resistance arm located at two opposite sides of the pivot, wherein a movement of the at least two effort arms toward each other brings the effort arms close to the virtual axis and accompanies a movement of the at least two resistance arms away from each other and away from the virtual axis;

wherein movement traces of the lever arms lie on a two-dimensional plane and the lever arms overlap thoroughly in a direction parallel to the two-dimensional plane so that one of the lever arms hides behind the other lever arm; and an adapter connected to the lock core and the fastener, comprising:

an U-shaped structure capable of moving in a direction substantially perpendicular to the two-dimensional plane;

wherein a rotation of the lock core about the first axis drives the adapter to drive the fastener to rotate about a second axis, wherein an opening of the U-shaped structure of the adapter moves toward the effort arms to have the effort arms gathering and received in the U-shaped structure;

wherein when the lock core is locked, the lock core restricts the fastener from rotating; when the lock core is unlocked, the fastener is operably rotated.

2. The lock of claim 1, wherein the lock core is a key lock core and is pressed to move toward the fastener and is locked; the lock core is unlocked under a key's operation and moves away from the fastener.

3. A lock for an electronic device having a lock hole, comprising:

a housing and a lock core; wherein the lock core is disposed in the housing, the housing has a first surface; and a fastener connected to the lock core, wherein the fastener includes at least two V-shaped like lever arms and extends out of the housing from the first surface, disposed on a virtual axis shifted away from the center of the first surface;

wherein a distance between the fastener and a side of an edge of the first surface is different from a distance between the fastener and the opposite side of the edge of the first surface, wherein a connecting line connecting the two opposites sides passes the fastener and the center of the first surface; and an adapter disposed in the housing, connected to the lock core and the fastener, comprising:

an U-shaped structure capable of moving in a direction substantially perpendicular to a two-dimensional plane;

wherein a rotation of the lock core drives the adapter to drive the lever arms of the fastener to have a lever action, wherein an opening of the U-shaped structure of the adapter moves toward one side of the lever arms to have the side of the lever arms gathering and received in the U-shaped structure.

4. The lock of claim 3, wherein the fastener includes a plurality of lever arms surrounding a virtual axis, the virtual axis intersects the first surface at a position between the edge and the center of the first surface.

5. The lock of claim 4, wherein each of the lever arms has a pivot, and an effort arm and a resistance arm located at two opposite sides of the pivot; the pivot, the effort arm, and the resistance arm constitute a V shape, the pivots of the lever arms are close to each other and surround the virtual axis.

6. The lock of claim 4, wherein the fastener has two lever arms symmetrically disposed asides the virtual axis.

* * * * *